US007878179B2

(12) United States Patent
Ikeya

(10) Patent No.: US 7,878,179 B2
(45) Date of Patent: Feb. 1, 2011

(54) FUEL SUPPLY APPARATUS

(75) Inventor: Masaki Ikeya, Obu (JP)

(73) Assignee: Aisan Kogyo Kabushiki Kaisha, Obu-shi, Aichi-ken (JP)

( * ) Notice: Subject to any disclaimer, the term of this patent is extended or adjusted under 35 U.S.C. 154(b) by 220 days.

(21) Appl. No.: 12/250,677

(22) Filed: Oct. 14, 2008

(65) Prior Publication Data

US 2009/0107471 A1 Apr. 30, 2009

(30) Foreign Application Priority Data

Oct. 26, 2007 (JP) ..... 2007-278705

(51) Int. Cl.
*F02M 69/54* (2006.01)

(52) U.S. Cl. ..... 123/457; 123/458; 123/510; 123/511; 123/514

(58) Field of Classification Search ..... 123/510, 123/511, 514, 457, 458; 137/505.12, 505.14, 137/505.16
See application file for complete search history.

(56) References Cited

U.S. PATENT DOCUMENTS 4,310,142 A * 1/1982 Ludwig ..... 251/30.03
4,606,317 A * 8/1986 Jauch et al. ..... 123/452
4,829,964 A * 5/1989 Asayama ..... 123/463
5,732,684 A * 3/1998 Thompson ..... 123/514
5,967,119 A * 10/1999 Burkhard et al. ..... 123/458
2003/0047169 A1 * 3/2003 Buse et al. ..... 123/457

FOREIGN PATENT DOCUMENTS

JP 64032066 2/1989
JP 2002235622 8/2002

* cited by examiner

*Primary Examiner*—Stephen K Cronin
*Assistant Examiner*—Anthony L Bacon
(74) *Attorney, Agent, or Firm*—Dennison, Schultz & MacDonald

(57) ABSTRACT

The present invention includes a fuel supply apparatus having a pressure regulator for regulating a pressure of fuel supplied from a fuel pump to a target, such as an internal combustion engine of an automobile. The pressure regulator includes a first pressure chamber, a second pressure chamber and a third pressure chamber each configured to be able to receive a supply of the fuel from the fuel pump. A first diaphragm separates the first pressure chamber and the second pressure chamber from each other. A second diaphragm separates the second pressure chamber and the third pressure chamber from each other. The first pressure chamber has a discharge port that can discharge the fuel supplied into the first pressure chamber. A valve assembly is coupled to the first and second diaphragms, so that the valve assembly can open and close the discharge port of the first pressure chamber in response to the balance of forces applied to the first and second diaphragms by pressures of the fuel within the first, second and third pressure chambers. A controller can control the pressure of the fuel within each of the second and third pressure chambers.

18 Claims, 5 Drawing Sheets

FUEL SUPPLY APPARATUS

This application claims priority to Japanese patent application serial number 2007-278705, the contents of which are incorporated herein by reference.

BACKGROUND OF THE INVENTION

1. Field of the Invention

The present invention relates to fuel supply apparatus for supplying fuel to an internal combustion engine of a vehicle, such as an automobile. In particular, the present invention relates to fuel supply apparatus having a pressure regulator that can adjust a pressure of fuel pumped by a fuel pump.

2. Description of the Related Art

A known fuel supply apparatus disclosed in Japanese Laid-Open Patent Publication No. 2002-235622 includes a fuel pump and a pressure regulator. The fuel pump feeds fuel to an internal combustion engine under pressure. The pressure regulator (pressure regulating valve) can regulate a pressure level of the fuel discharged from the fuel pump to a high level or a low level. The fuel pump and the pressure regulator are modularized and are disposed within a fuel tank. The fuel pump and the pressure regulator communicate with each other via a communication pipe. The communication pipe is branched from a fuel delivery pipe. The fuel delivery pipe communicates between the fuel pump and an injector(s) that can inject fuel into the engine. Therefore, a part of the fuel discharged from the fuel pump is supplied to the pressure regulator where the pressure is adjusted. The pressure regulator includes a first pressure chamber and a second pressure chamber. A return pipe is connected to the first pressure chamber for returning the fuel into the fuel tank. The second pressure chamber has a bag-like configuration with no fuel outlet. A diaphragm separates the first chamber and the second chamber from each other and supports a valve member that is operable to open and close an opening of the return pipe. A first introduction pipe and a second introduction pipe are branched from the fuel delivery pipe. The pressure of the fuel discharged from the fuel pump is directly applied to the first pressure chamber via the first introduction pipe. The fuel supplied to the first pressure chamber returns into the fuel tank via the return pipe. The fuel is supplied to the second pressure chamber via the second introduction pipe. However, the return pipe also communicates with the second introduction pipe in a branched manner, so that a part of the fuel supplied from the fuel delivery pipe returns into the fuel tank via a throttle. Therefore, the second pressure chamber receives a middle pressure that has an intermediate value between the discharge pressure of the fuel pump and the pressure within the fuel tank.

Another known fuel supply apparatus disclosed in Japanese Laid-Open Patent Publication No. 64-32066 includes a fuel pump and a pressure regulator that are positioned outside of a fuel tank. In this publication, the pressure regulator regulates the fuel pressure by using the pressure of the fuel discharged from the fuel pump, the atmospheric pressure and a negative pressure at an air intake port. More specifically, the pressure regulator includes a first negative pressure chamber, a second negative pressure chamber and a fuel chamber. The first negative pressure chamber and the second negative pressure chamber are separated from each other by a first diaphragm. The second negative pressure chamber and the fuel chamber are separated from each other by a second diaphragm that has a pressure receiving area smaller than a pressure receiving area of the first diaphragm. A first changeover device and a second changeover device each configured as a three-way valve are associated with the first negative pressure chamber and the second negative pressure chamber, respectively, so that the first negative pressure chamber and the second negative pressure chamber can selectively communicate with either of a negative pressure introduction pipe for introducing the negative pressure from the air intake port, a negative pressure communication pipe communicating with a negative pressure tank that accumulates the negative pressure applied from the air intake port, and an atmospheric pressure introduction port. A part of the fuel pumped by the fuel pump is always supplied to the fuel chamber. For setting the fuel pressure to a high level when the fuel is at a high temperature, the atmospheric pressure is introduced into the first negative pressure chamber, and the negative pressure is introduced from the negative pressure tank into the second negative pressure chamber. For setting the fuel pressure to a middle level when the fuel is at a middle temperature, the atmospheric pressure is introduced into both of the first negative pressure chamber and the second negative pressure chamber. For setting the fuel pressure to a low level when the fuel is at a low temperature, the negative pressure from the air intake port is introduced into both of the first negative pressure chamber and the second negative pressure chamber. In this way, it is possible to adjust the pressure of the fuel pumped by the fuel pump to the high level, the middle level or the low level.

In the case of the arrangement of the Publication No. 2002-235622, the pressure is adjusted using only the pressure of the fuel discharged from the fuel pump. Therefore, the pressure regulator and the fuel pump can be modularized and can be disposed within the fuel tank. Hence, it is possible to save the installation space. However, because the pressure regulator has only the first and second pressure chambers separated by the first diaphragm, the fuel pressure can be adjusted to only two different pressure levels, i.e., the high level and the low level. In addition, although the middle pressure between the discharge pressure of the fuel pump and the pressure within the fuel tank is applied to the second pressure chamber, the middle pressure is produced by the throttle that is provided across the branch point between the second introduction pipe and the return pipe, and the second chamber has a bag-like configuration with no fuel outlet. Therefore, there is a possibility that the vapor produced within the fuel may stay within the second pressure chamber to cause improper pressure adjustment.

In the case of the arrangement of the Publication No. 64-32066, the pressure regulator includes the first negative pressure chamber, the second negative pressure chamber and the fuel chamber that are separated from each other by the first and second diaphragms having different pressure receiving areas. Therefore, it is possible to adjust the pressure of the fuel to three different pressure levels including the high level, the middle level and the low level. However, in this publication, the fuel pressure is adjusted by using the pressure of the fuel, the atmospheric pressure and the negative pressure of the air intake pipe. Therefore, it is not possible to modularize the fuel pump and the pressure regulator. For this reason, the fuel pump and the pressure regulators are disposed outside of the fuel tank. This may lead to increase the size of the system. In addition, the first changeover device, the second changeover device, the negative pressure tank, etc., are required for selectively introducing the atmospheric pressure and the negative pressure of the air intake pipe into each of the first and second negative pressure chambers. Therefore, the number of components required for the system is large, and the piping paths are complicated. Further, for achieving the high pressure level, the fuel pressure is applied to the fuel chamber, while the atmospheric pressure and the negative pressure are applied to the first negative pressure chamber and the second negative pressure chamber, respectively. Therefore, a maximum pressure value that can be achieved by this arrangement may be no more than a value that slightly exceeds the sum of the usually applied pressure and the atmospheric pressure. Furthermore, according to this publication, the pressure receiving area of the second diaphragm is smaller than the pressure receiving area of the first diaphragm. No other arrangement is disclosed in this publication.

Therefore, there is a need in the art for fuel supply apparatus that can achieve at least three different pressure levels while enabling modularization of a fuel pump and a pressure regulator.

SUMMARY OF THE INVENTION

One aspect according to the present invention includes a fuel supply apparatus having a pressure regulator for regulating a pressure of a fuel supplied from a fuel pump to a target, such as an internal combustion engine of an automobile. The pressure regulator includes a first pressure chamber, a second pressure chamber and a third pressure chamber each configured to be able to receive a supply of the fuel from the fuel pump. A first diaphragm separates the first pressure chamber and the second pressure chamber from each other. A second diaphragm separates the second pressure chamber and the third pressure chamber from each other. The first pressure chamber has a discharge port that can discharge the fuel supplied into the first pressure chamber. A valve assembly is coupled to the first and second diaphragms, so that the valve assembly can open and close the discharge port of the first pressure chamber in response to forces applied to the first and second diaphragms by pressures of the fuel within the first, second and third pressure chambers. A controller can control the pressure of the fuel within each of the second and third pressure chambers.

DETAILED DESCRIPTION OF THE INVENTION

Figure 1:
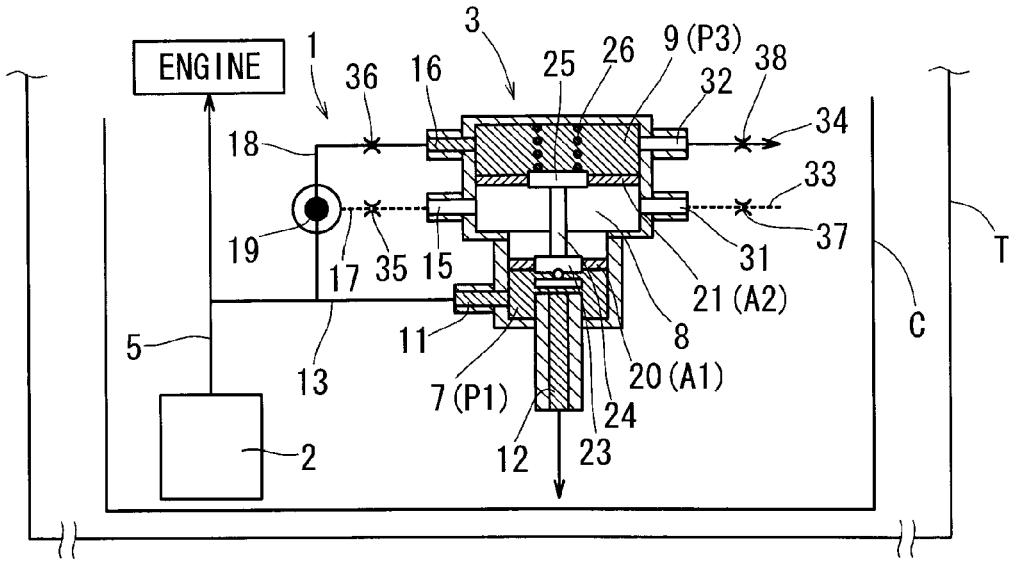
FIGS. 1(A), 1(B) and 1(C) are schematic views showing different operational modes of a fuel supply apparatus according to a first embodiment of the present invention.
Figure 1:
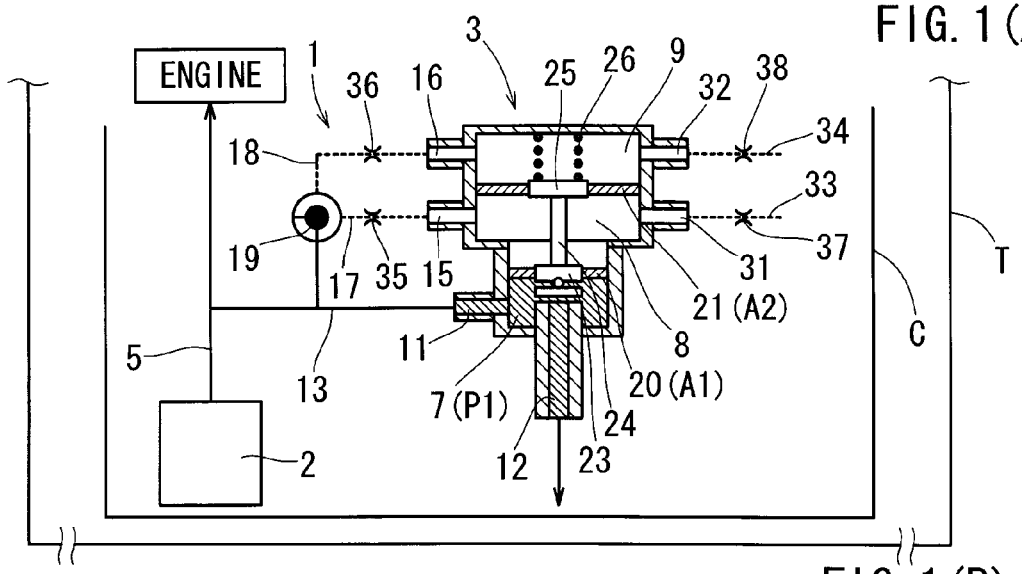
Figure 1:
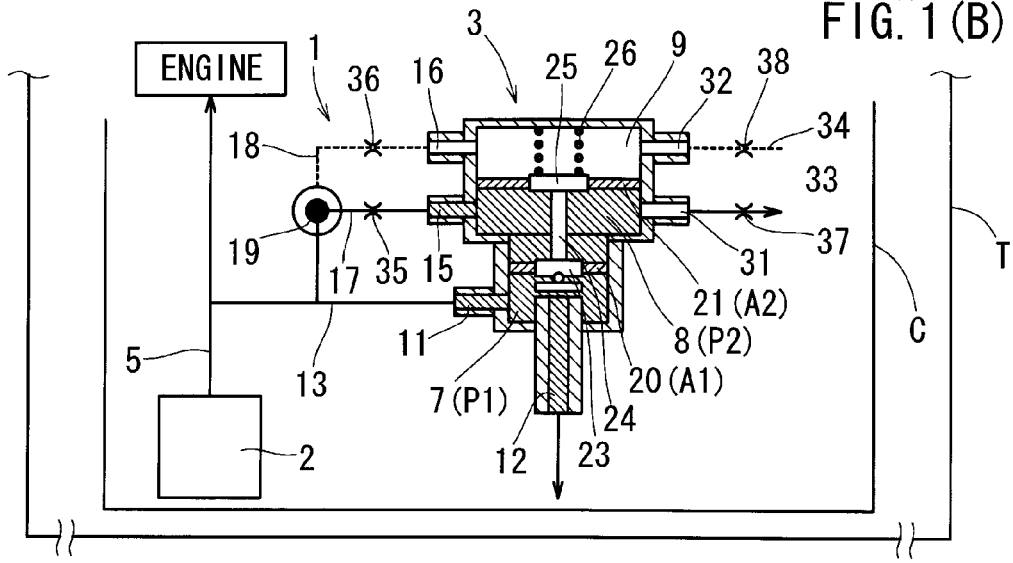
Figure 2:
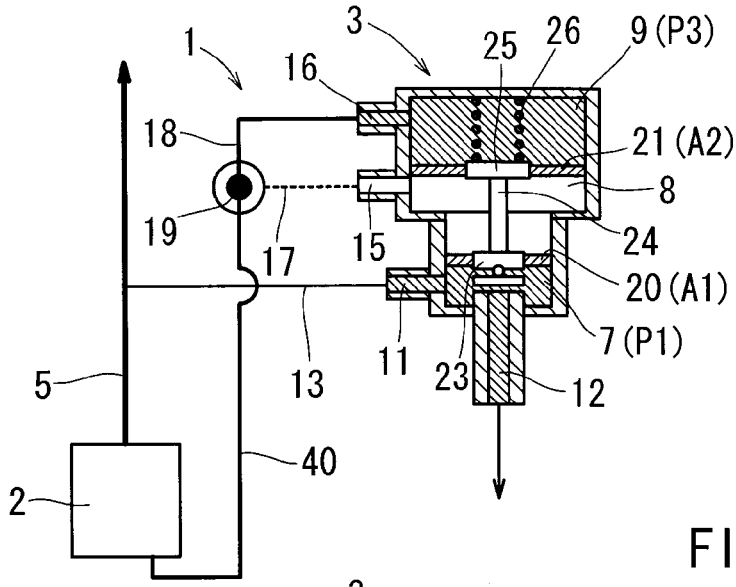
FIGS. 2(A), 2(B) and 2(C) are schematic views showing different operational modes of a fuel supply apparatus according to a second embodiment of the present invention.
Figure 2:
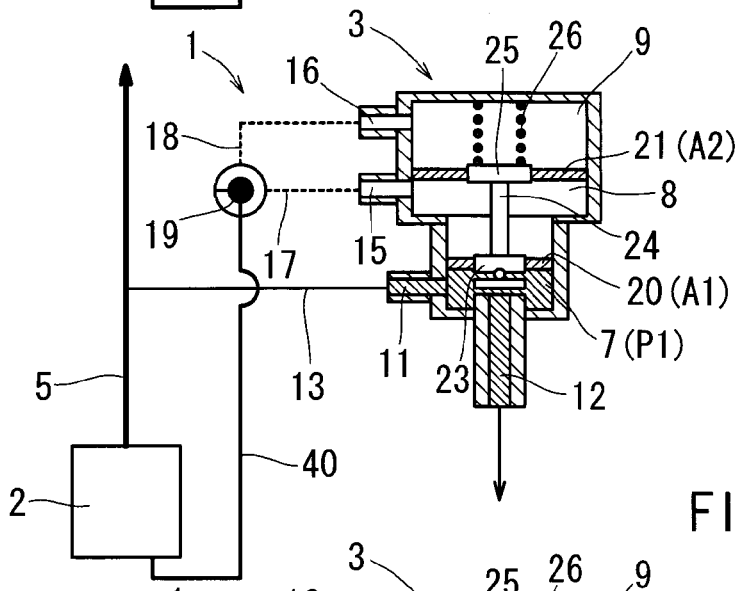
Figure 2:
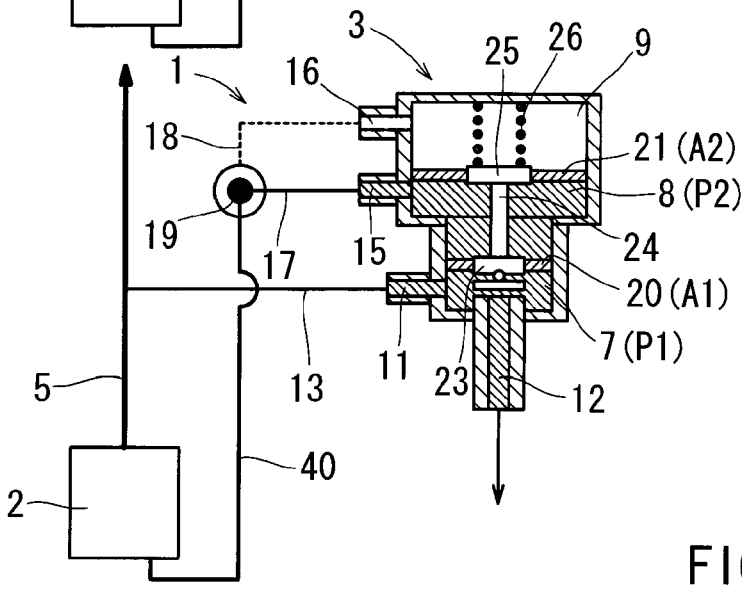
Figure 3:
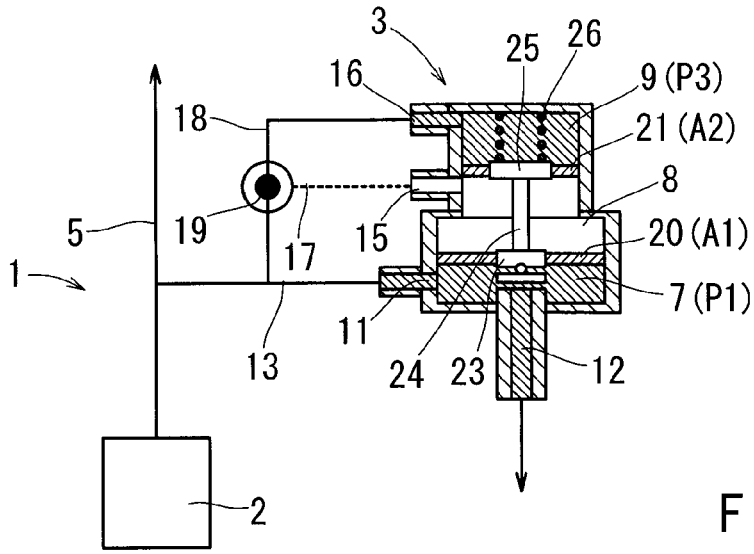
FIGS. 3(A), 3(B) and 3(C) are schematic views showing different operational modes of a fuel supply apparatus according to a third embodiment of the present invention.
Figure 3:
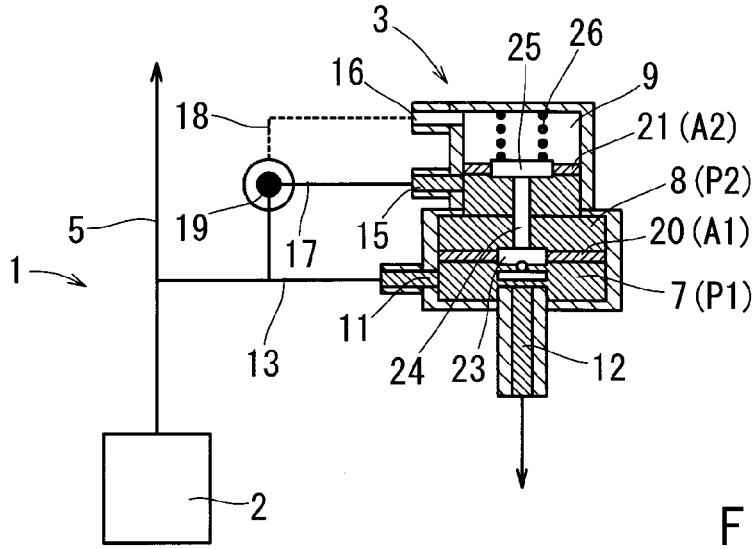
Figure 3:
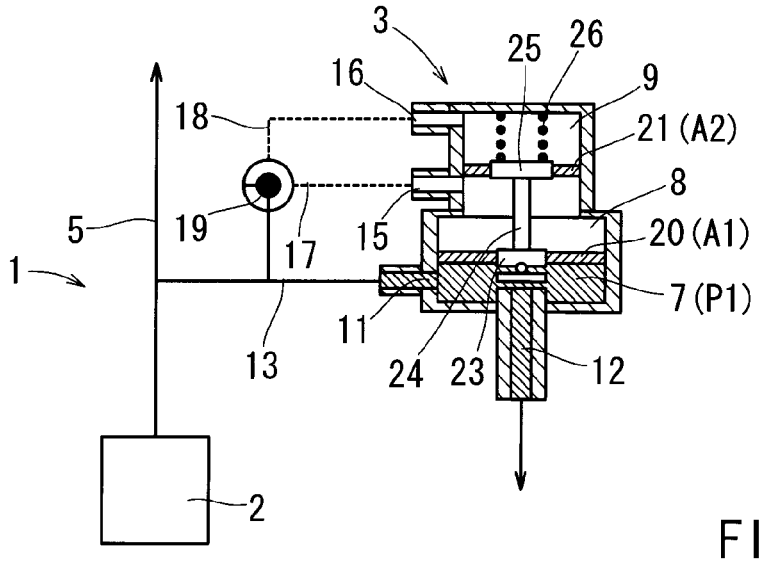
Figure 4:
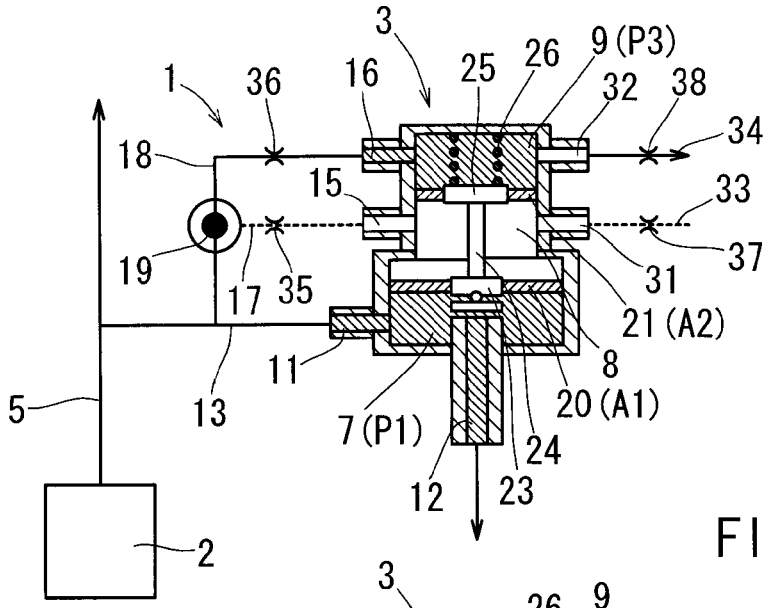
FIGS. 4(A), 4(B) and 4(C) are schematic views showing different operational modes of a fuel supply apparatus according to a fourth embodiment of the present invention.
Figure 4:
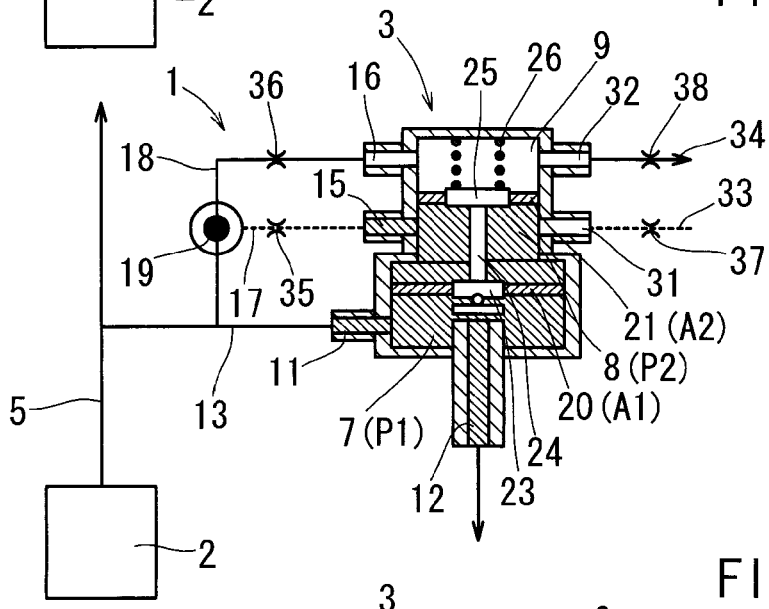
Figure 4:
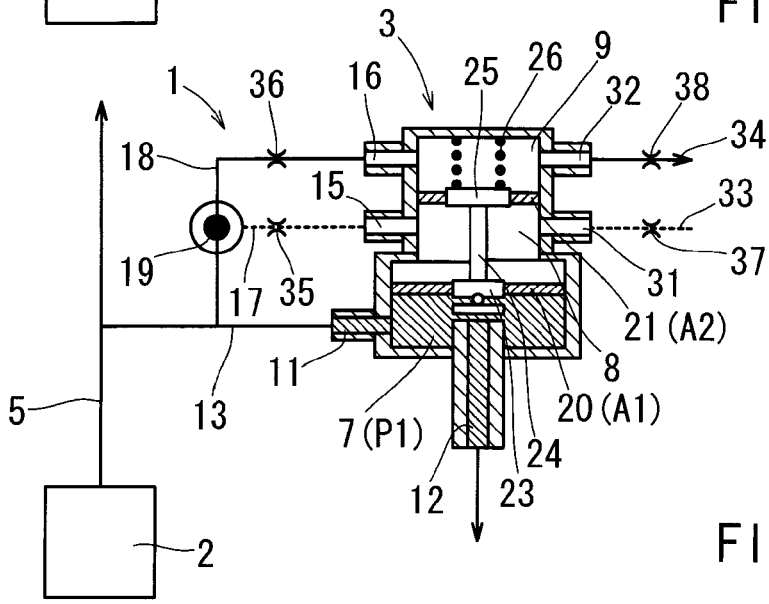

Each of the additional features and teachings disclosed above and below may be utilized separately or in conjunction with other features and teachings to provide improved fuel supply apparatus. Representative examples of the present invention, which examples utilize many of these additional features and teachings both separately and in conjunction with one another, will now be described in detail with reference to the attached drawings. This detailed description is merely intended to teach a person of skill in the art further details for practicing preferred aspects of the present teachings and is not intended to limit the scope of the invention. Only the claims define the scope of the claimed invention. Therefore, combinations of features and steps disclosed in the following detailed description may not be necessary to practice the invention in the broadest sense, and are instead taught merely to particularly describe representative examples of the invention. Moreover, various features of the representative examples and the dependent claims may be combined in ways that are not specifically enumerated in order to provide additional useful embodiments of the present teachings.

In one embodiment, a fuel supply apparatus includes a fuel pump and a pressure regulator that are disposed within a fuel tank. The fuel pump is connected to a fuel delivery pipe for delivering a fuel to an internal combustion engine. The pressure regulator can adjust a pressure of the fuel fed through the fuel delivery pipe. The pressure regulator includes a first pressure chamber including a return port for returning the fuel into the fuel tank, a second pressure chamber, and a third pressure chamber. In addition, the pressure regulator includes a valve assembly including a valve member capable of opening and closing the return port, a pressure receiving member and a connecting rod connecting between the valve member and the pressure receiving member, so that the valve member can move together with the pressure receiving member. The pressure regulator further includes a first diaphragm and a second diaphragm. The first diaphragm has a first pressure receiving area and separates the first pressure chamber and the second pressure chamber from each other. The first diaphragm resiliently supports the valve member. The second diaphragm has a second pressure receiving area and separates the second pressure chamber and the third pressure chamber from each other. The first pressure receiving area and the second pressure receiving area are different from each other. A first introduction passage connects between the fuel pump and the first pressure chamber. A second introduction passage connects between the fuel pump and the second pressure chamber. A third introduction passage connects between the fuel pump and the third pressure chamber. A changeover device can selectively permit or prevent communication between the second introduction passage and the second pressure chamber and can selectively permit or prevent communication between the third introduction passage and the third pressure chamber, so that the fuel from the fuel pump can be selectively introduced into the second pressure chamber and can be selectively introduced into the third pressure chamber. Therefore, a supply pressure of the fuel fed through the fuel delivery pipe can be adjusted to any one of a first level, a second level lower than the first level, and a third level lower than the second level.

With this arrangement, because the fuel pump and the pressure regulator are modularized, the fuel supply apparatus may have a compact construction. In addition, the module of the fuel pump and pressure regulator can be disposed within the fuel tank, and therefore, it is possible to save the installation space. Further, the pressure regulator is separated into the first, second and third pressure chambers by the first and second diaphragms having different pressure receiving areas from each other, so that the fuel pressure from the fuel pump can be regulated to any one of the first, second and third levels. Therefore, an adjustable pressure range can be broadened than the pressure range available by a conventional regulator that utilizes the atmospheric pressure or a negative pressure for regulating the fuel pressure. In addition, in order to adjust the fuel pressure, the changeover device can selectively permit and prevent communication between the second introduction passage and the second pressure chamber and can selectively permit and prevent communication between the third introduction passage and the third pressure chamber. Therefore, the number of components of the fuel supply apparatus can be minimized, and it is possible to simplify the piping paths for the fuel.

In another embodiment, the second pressure receiving area of the second diaphragm is set to be larger than the first pressure receiving area of the first diaphragm. The first pressure chamber directly receives the supply of the fuel having a discharge pressure from the fuel pump. At least the third pressure chamber of the second pressure chamber and the third pressure chamber receives the supply of the fuel having a pressure lower than the discharge pressure. The changeover device is operable in a first mode, a second mode and a third mode. In the first mode, the first and third pressure chambers receive the supply of the fuel, so that the supply pressure is set to the first level. In the second mode, only the first pressure chamber receives the supply of the fuel, so that the supply pressure is set to the second level. In the third mode, the first and second pressure chambers receive the supply of the fuel, so that the supply pressure is set to the third level.

Because at least the third pressure chamber receives the supply of the fuel having a pressure lower than the discharge pressure, the valve member can move in the opening direction while ensuring the high-pressure condition of the fuel fed through the delivery pipe. Therefore, it is possible to reliably avoid a situation where the return port of the first pressure chamber cannot be opened due to the pressure within the third pressure chamber.

In an alternative embodiment, the second pressure receiving area of the second diaphragm is set to be smaller than the first pressure receiving area of the first diaphragm. In the first mode, the first and third pressure chambers receive the supply of the fuel, so that the supply pressure is set to the first level. In the second mode, the first and second pressure chambers receive the supply of the fuel, so that the supply pressure is set to the second level. In the third mode, only the first pressure chamber receives the supply of the fuel, so that the supply pressure is set to the third level.

In this way, by suitably selecting the pressure chamber to which the fuel is supplied, it is possible to set the fuel pressure to any one of the first, second and third levels. Therefore, the freedom of design of the fuel supply apparatus can be improved.

In one embodiment, the first introduction passage communicates with the fuel delivery pipe. The second and third introduction passages communicate with the first introduction passage via the changeover device. Each of the second and third pressure chambers communicates with the inside of the fuel tank via a return port. A first throttle and a second throttle are disposed within the second introduction passage and the third introduction passage, respectively. A third throttle is disposed on a downstream side of the return port of the second pressure chamber. A fourth throttle is disposed on a downstream side of the return port of the third pressure chamber. A throttling amount of the third throttle is greater than a throttling amount of the first throttle, so that the flow area defined by the third throttle is smaller than the flow area defined by the first throttle. A throttling amount of the fourth throttle is greater than a throttling amount of the second throttle, so that the flow area defined by the fourth throttle is smaller than the flow area defined by the second throttle.

The piping path can be simplified by communicating the second and third introduction passages with the first introduction passage via the changeover device. Because the throttles are provided on the upstream side and the downstream side of each of the second and third pressure chambers, it is possible to introduce the fuel having a lower pressure than the discharge pressure into the second and third pressure chambers by using a simple construction. In addition, by suitably adjusting the throttling amount of each of the throttles, it is possible to easily change the pressure of the fuel supplied to each of the second and third pressure chambers. Further, by providing the discharge ports also to the second and third pressure chambers, the fuel can flow through the second and third pressure chambers, so that it is possible to avoid potential fuel vapor from staying within the second and third pressure chambers.

In another embodiment, the fuel delivery pipe receives the supply of the fuel discharged from the fuel pump at an end of the pressurizing process of the fuel pump. The first introduction passage communicates with the fuel delivery pipe. The second and third introduction passages communicate with the fuel pump via a middle pressure passage. The middle pressure passage receives the supply of the fuel discharged from the fuel pump at an intermediate step of the pressurizing process of the fuel.

The fuel pump may include an impeller(s) having a plurality of fin grooves formed in its outer peripheral portion. The fuel is pumped and pressurized as the impeller rotates. A fuel passage is formed to surround the outer peripheral portion of the impeller and extends in the circumferential direction, so that the pressure of the fuel within the fuel passage increases in a downstream direction along the fuel passage. Hence, the pressure of the fuel has a maximum value at the downstream side end of the fuel passage, i.e., at the end of the pressuring process of the fuel pump. The fuel delivery pipe is connected to the fuel pump such that the fuel delivery pipe receives the supply of the fuel discharged from the fuel pump at the end of the pressurizing process of the fuel pump. On the other hand, the middle pressure passage receives the supply of the fuel discharged from the fuel pump at the intermediate step of the pressurizing process of the fuel. Therefore, it is possible to effectively introduce the fuel having a pressure lower than the discharge pressure of the fuel pump into each of the second and third pressure chambers by incorporating a simple construction that takes advantage of the pressurizing process of the fuel pump.

In another embodiment, a fuel supply apparatus for supplying a fuel to a target includes a fuel pump, a fuel delivery passage communicating between the fuel pump and the target, and a pressure regulator constructed to regulate a pressure of fuel fed to the target through the fuel delivery passage. The pressure regulator includes a first pressure chamber, a second pressure chamber and a third pressure chamber each configured to be able to received a supply of the fuel from the fuel pump, a first diaphragm separating the first pressure chamber and the second pressure chamber from each other, and a second diaphragm separating the second pressure chamber and the third pressure chamber from each other. The first pressure chamber has a discharge port configured to discharge the fuel supplied into the first pressure chamber. A valve assembly is coupled to the first and second diaphragms, so that the valve assembly can open and close the discharge port of the first pressure chamber in response to forces applied to the first and second diaphragms by pressures of the fuel within the first, second and third pressure chambers. A controller controls the pressure of the fuel within each of the second and third pressure chambers.

First Embodiment

A first embodiment of the present invention will now be described with reference to FIGS. 1(A), 1(B) and 1(C).

(Basic Construction)

The basic construction of a fuel supply apparatus 1A according to the first embodiment will be first described. The fuel supply apparatus 1A includes a fuel pump 2 and a pressure regulator 3 that are modularized and positioned within a reservoir cup C. The reservoir cup C is disposed within a fuel tank T. The fuel tank T is mounted to a vehicle, such as an automobile (not shown), at a suitable position. A fuel delivery pipe 5 is connected to the fuel pump 2 in order to feed the fuel to an engine, i.e., an internal combustion engine. Although not shown in the drawings, a suction filter is provided on an upstream side of a fuel suction port of the fuel pump 2, and a fuel filter is provided on a downstream side of a fuel discharge port of the fuel pump 2. At least one impeller (not shown) is disposed within the fuel pump 2 and is rotatably driven to pump the fuel. More specifically, as the impeller(s) rotates, the fuel is drawn into the fuel pump 2 via the fuel suction pot and is discharged from the fuel discharge port under pressure. The fuel discharged from the fuel discharge port is fed to the fuel delivery pipe 5 and is consequently injected into the engine by means of an injector(s). The amount of the fuel injected into the engine by the injector(s) largely depends on the pressure of the fuel supplied to the injector(s). The fuel supply apparatus 1A includes a pressure regulator 3 that can regulate the pressure of the fuel to three different levels, i.e., a high level, a middle level and a low level. Here, the fuel is discharged from the fuel pump 2 at a maximum pressure that is available by the fuel pump 2.

The inside of the pressure regulator 3 is divided into three chambers including a first pressure chamber 7, a second pressure chamber 8 and a third pressure chamber 9 arranged in this order starting from the bottom in FIG. 1(A). The pressure regulator 3 has a fuel introduction port 11 for introducing the fuel into the first pressure chamber 7 and a return port 12 for returning the fuel from the first pressure chamber 7 into the fuel tank T. Each of the fuel introduction port 11 and the return port 12 is open into and out of the first pressure chamber 7. One end of a first introduction pipe 13 is connected to the fuel introduction port 11. The other end of the first introduction pipe 13 is connected to the fuel delivery pipe 5. Therefore, a part of the fuel that is discharged from the fuel pump 2 and fed through the fuel delivery pipe 5 is introduced into the first pressure chamber 7 via the first introduction pipe 13 and the fuel introduction port 11. The pressure regulator 3 also has a fuel introduction port 15 and a fuel introduction port 16 for introducing the fuel into the second pressure chamber 8 and the third pressure chamber 9, respectively. The fuel introduction port 15 and the fuel introduction port 16 are open into and out of the second pressure chamber 8 and the third pressure chamber 9, respectively. One end of a second introduction pipe 17 and one end of a third introduction pipe 18 are connected to the fuel introduction port 15 and the fuel introduction port 16, respectively. The other end of the second introduction pipe 17 and the other end of the third introduction pipe 18 are connected to a single changeover device 19 that is operable to selectively permit and prevent communication between the first introduction pipe 13 and each of the second introduction pipe 17 and the third introduction pipe 18. In this embodiment, the changeover device 19 is a three-way valve.

A first diaphragm 20 separates the first pressure chamber 7 and the second pressure chamber 8 from each other. A second diaphragm 21 separates the second pressure chamber 8 and the third pressure chamber 9 from each other. A pressure receiving area of the first diaphragm 20 and a pressure receiving area of the second diaphragm 21 are different from each other. Within the pressure regulator 3, a valve assembly including a valve member 23 and a pressure receiving member 25 are disposed. The valve member 23 serves to open and close the return port 12 of the first pressure chamber 7. The pressure receiving member 25 is connected to the valve member 23 via a connecting rod 24, so that the pressure receiving member 25 can move vertically in unison with the valve member 23. The valve member 23 is supported by the first diaphragm 20, so that the valve member 23 can move vertically as the first diaphragm 20 resiliently deforms. The pressure receiving member 25 is supported by the second diaphragm 21, so that the pressure receiving member 25 can move vertically as the second diaphragm 21 deforms. In this way, the first pressure chamber 7 and the second pressure chamber 8 are separated from each other by the first diaphragm 20 and the valve member 23 such that the fuel is prevented from flowing therebetween. Similarly, the second pressure chamber 8 and the third pressure chamber 9 are separated from each other by the second diaphragm 21 such that the fuel is prevented from flowing therebetween. A compression coil spring 26 is interleaved between the pressure receiving member 25 and the top wall of the third pressure chamber 9 (i.e., the top wall of the pressure regulator 3), so that the valve assembly is normally biased downward. Therefore, under the inoperative condition of the fuel supply apparatus 1A, the valve member 23 closes the return port 12 of the first pressure chamber 7.

With the basic construction described above, by selectively introducing the pressurized fuel discharged from the fuel pump 2 to the second pressure chamber 8 and/or the second pressure chamber 9 by the operation of the changeover device 19, it is possible to achieve change in amount of opening of the return port 12. The amount of opening of the return port 12 can change in a stepwise fashion depending on the position of the valve member 23. More specifically, the pressure of the fuel supplied to the engine (more specifically, the injector(s)) from the fuel pump 2 via the fuel delivery pipe 5 can be adjusted to any one of three different levels, i.e., a high level, a middle level and a low level. A force F of lifting the valve member 23 upward, i.e., a force of opening the return port 12 of the first pressure chamber 7, may be calculated by the following expression:

$$F=(P1*A1)-(P2*A1)+(P2*A2)-(P3*A2) \quad \text{Expression (1)}$$

Here, P1 denotes a pressure of the fuel introduced into the first pressure chamber 7, P2 denotes a pressure of the fuel introduced into the second pressure chamber 8, P3 denotes a pressure of the fuel introduced into the third pressure chamber 9, A1 denotes a pressure receiving area of the first diaphragm 20, and A2 denotes a pressure receiving area of the second diaphragm 21.

During the stop of the engine of the vehicle, the temperature of the fuel stored within the fuel tank T may be high or low depending on the external environment. For example, in summer or in a tropical area, it may be possible that the temperature of the fuel within the fuel tank T rises to 80° C. or more. On the other hand, in winter or in a cold area, it may be possible that the temperature may be lowered to −10° C. or less. Under the high temperature condition or the low temperature condition, there is a possibility that the engine cannot be restarted or is difficult to be restarted due to production of fuel vapor in the fuel (in the case of the high temperature condition) or due to insufficient atomization of the fuel (in the case of the low temperature condition). In order to avoid this situation, it may be preferable to increase the pressure of the fuel supplied to the engine (more specifically, the injector(s)) to a high pressure. However, if the fuel supply apparatus is continuously operated during a long time period while maintaining the fuel pressure at a high level, electric power that may be consumed by the fuel pump 2 may increase, and therefore, the fuel economy may be lowered. Therefore, it may be preferable to change the fuel pressure from a high level to a low level after restarting the engine. However, if the fuel pressure is abruptly changed from the high level to the low level, the air-fuel ratio may be abruptly changed to cause improper operation of the engine. For this reason, it may be appropriate to change the fuel pressure from the high level to a middle level and to thereafter change from the middle level to the low level. The timing of changing the fuel pressure from the high level to the middle level and the timing of changing the fuel pressure from the middle level to the low level may be suitably determined. Typically, these timings may be determined based on the fuel temperature within the fuel tank T or the temperature of cooling water of the engine. For example, if the temperature of the fuel within the fuel tank T is higher than about −5° C. or lower than about 50° C. when the engine is restarted, the fuel pressure may then be increased from the low level.

<Detailed Explanation of First Embodiment>

FIGS. 1(A), 1(B) and 1(C) show a high pressure mode, a middle pressure mode and a low pressure mode of the fuel supply apparatus 1A, respectively. In addition to the basic construction described above, the pressure regulator 3 of the fuel supply apparatus 1A of this embodiment includes return ports 31 and 32 that are formed in communication with the second pressure chamber 8 and the third pressure chamber 9, respectively, for returning the introduced fuel into the fuel tank T. The return ports 31 and 32 are open into and out of the second pressure chamber 8 and the third pressure chamber 9, respectively. Return pipes 33 and 34 are connected to the return ports 31 and 32, respectively, and are in communication with the inner space of the fuel tank T. Throttles 35 and 36 are disposed within the second introduction pipe 17 and the third introduction pipe 18, respectively, for restricting the flow of the fuel therethrough. The second introduction pipe 17 is connected to the upstream side of the second pressure chamber 8, and the third introduction pipe 18 is connected to the upstream side of the third pressure chamber 9. Similarly, throttles 37 and 38 are disposed within the return pipes 33 and 34, respectively, for restricting the flow of the fuel therethrough. The return pipe 33 is connected to the downstream side of the second pressure chamber 8, and the return pipe 34 is connected to the downstream side of the third pressure chamber 9. The amount of restriction of flow by the throttles 37 and 38, i.e., the throttling amount of the throttles 37 and 38, positioned on the downstream side of the second and third pressure chambers 8 and 9 are set to be greater than the amount of restriction of flow by the throttles 35 and 36, i.e., the throttling amount of the throttles 35 and 36, positioned on the upstream side of the second and third pressure chambers 8 and 9. The pressure receiving area A2 of the second diaphragm 21 is set to be larger than the pressure receiving area Al of the first diaphragm 20. The second introduction pipe 17 and the third introduction pipe 18 are connected to the first introduction pipe 13 via the changeover device or the three-way valve 19 in such a manner that the second introduction pipe 17 and the third introduction pipe 18 are branched from the first introduction pipe 13 via the three-way valve 19. With this arrangement, the discharge pressure of the fuel pump 2 is directly introduced into the first pressure chamber 7, while a pressure lower than the discharge pressure of the fuel pump 2 is introduced into each of the second pressure chamber 8 and the third pressure chamber 9.

In order to set the fuel pressure within the fuel delivery pipe 5 to a high pressure, the three-way valve 19 is operated to bring the second introduction pipe 17 to a non-communicating condition and to bring the third introduction pipe 18 to a communicating condition. Here, the terms "non-communicating condition" and "communicating condition" are used to mean the non-communicating condition and the communicating condition with the first introduction pipe 13, respectively. Therefore, the fuel may be introduced into the first pressure chamber 7 and the third pressure chamber 9. Here, although the discharge pressure of the fuel pump 2 is directly introduced into the first pressure chamber 7, a pressure lower than the discharge pressure is introduced into the third pressure chamber 9 because of the presence of the throttles 36 and 38 that are positioned on the upstream side and the downstream side of the third pressure chamber 9, respectively. Therefore, the force F of lifting the valve member 23 upward or the force of opening the return port 12 of the first pressure chamber 7 may be calculated by the following expression based on the above expression (1):

$$F=(P1*A1)-(P3*A2) \qquad \text{Expression (2)}$$

Thus, the valve member 23 receives a force (P1*A1) in an opening direction by the pressure within the first pressure chamber 7 and receives a force (P3*A2) in a closing direction by the pressure within the third pressure chamber 9. Therefore, an amount of opening of the return port 12 is small, so that the pressure of the fuel fed through the fuel delivery pipe 5 is set to a high level. As a result, the high pressure mode of the fuel supply apparatus 1A can be achieved. Here, although A1 and A2 have the relationship of A1<A2, the force F has a positive value and is greater than the biasing force of the spring 26 because of the setting of the relationship of P1>P3. Therefore, the restricting amount of each of the throttles 36 and 38 positioned on the upstream side and the downstream side of the third pressure chamber 9, respectively, and the pressure receiving area A1 of the first diaphragm 20, and the pressure receiving area A2 of the second diaphragm 21 should be determined to satisfy at least the following expression:

$$(P1*A1)>(P3*A2) \qquad \text{Expression (3)}$$

The values of P1, P3, A1 and A2 may be suitably determined as long as the above expression (3) can be satisfied. As for the relationship between the pressure receiving area A1 of the first diaphragm 20 and the pressure receiving area A2 of the second diaphragm 21, it may be preferably that the area A2 is greater than half of the area A1 but is smaller than that area A1. The pressure of the fuel fed through the fuel delivery pipe 5 may increase as the value of (P3*A2) becomes nearer to the value of (P1*A1). The fuel pressure (high pressure level) fed through the fuel delivery pipe 5 may decrease as the difference between the value of (P3*A2) and the value of (P1*A1) increases.

In order to set the fuel pressure within the fuel delivery pipe 5 to the middle level, the three-way valve 19 is operated to bring both of the second introduction pipe 17 and the third introduction pipe 18 to the non-communicating condition, so that the fuel is introduced into only the first pressure chamber 17 as shown in FIG. 1(B). In such a case, the force F of lifting the valve member 23 upward or the force of opening the return port 12 of the first pressure chamber 7 may be calculated by the following expression based on the above expression (1):

$$F=(P1*A1) \quad \text{Expression (4)}$$

Thus, the valve member 23 receives only the force (P1*A1) in the opening direction by the pressure within the first pressure chamber 7. Therefore, the amount of opening of the valve member 23 becomes greater than in the case of setting the fuel pressure to the high level described above. Hence, the fuel pressure within the fuel delivery pipe 5 can be set to the middle level. As a result, the middle pressure mode of the fuel supply apparatus 1A can be achieved.

In order to set the fuel pressure within the fuel delivery pipe 5 to the low level, the three-way valve 19 is operated to bring the second introduction pipe 17 to the communicating condition and the third introduction pipe 18 to the non-communicating condition, so that the fuel is introduced into the first pressure chamber 7 and the second pressure chamber 8 as shown in FIG. 1(C). Here, although the discharge pressure of the fuel pump 2 is directly introduced into the first pressure chamber 7, a pressure lower than the discharge pressure is introduced into the second pressure chamber 8 because of the presence of the throttles 35 and 37 that are positioned on the upstream side and the downstream side of the second pressure chamber 8, respectively. Therefore, the force F of lifting the valve member 23 upward or the force of opening the return port 12 of the first pressure chamber 7 may be calculated by the following expression (5):

$$F=((P1-P2)*A1)+(P2*A2) \quad \text{Expression (5)}$$

Thus, the valve member 23 receives a force (P1*A1) and also receives a force (P2*A2) in the opening direction by the pressure within the first pressure chamber 7. On the other hand, the valve member 23 receives a force (P2*A1) in a closing direction by the pressure within the third pressure chamber 9. Here, the relationship of A1<A2 and the relationship of P1>P2 exist, and therefore, the difference between the value of (P2*A1) and the value of (P1*A1) plus (P2*A2) is very small. Therefore the amount of opening of the return port 12 may increase. Hence, the amount of opening of the valve member 23 increases than in the case of setting the fuel pressure to the middle level described above. As a result, the fuel pressure within the fuel delivery pipe 5 can be set to the low level, and the low pressure mode of the fuel supply apparatus 1A can be achieved.

The relationship between the restricting amounts of the throttles 35 and 37 positioned on the upstream side and the downstream side of the second pressure chamber 8 may be arbitrarily determined as long as the restricting amount of the upstream side throttle 35 is smaller than that of the downstream side throttle 37. There is no limitation to the value of the pressure P2 introduced into the second pressure chamber 8.

Second, third, fourth and fifth embodiments will now be described with reference to FIGS. 2(A), 2(B) and 2(C), FIGS. 3(A), 3(B) and 3(C), FIGS. 4(A), 4(B) and 4(C), and FIGS. 5(A), 5(B) and 5(C). These embodiments are modifications of the first embodiment and their basic constructions are the same as the basic construction of the first embodiment. Therefore, in FIGS. 2(A), 2(B) to FIGS. 5(A), 5(B) and 5(C), like members are labeled with the same reference numerals as the first embodiment. In addition, the reservoir cup C and the fuel tank T and engine are omitted in these figures.

Second Embodiment

The second embodiment of the present invention will now be described with reference to FIGS. 2(A), 2(B) and 2(C), which show a high pressure mode, a middle pressure mode and a low pressure mode of a fuel supply apparatus 1B of the second embodiment, respectively. Similar to the first embodiment, the pressure receiving area A2 of the second diaphragm 21 of the pressure regulator 3 is set to be larger than the pressure receiving area A1 of the first diaphragm 20. In the second embodiment, one end of a middle pressure pipe 40 is connected to the fuel pump 2 at a position corresponding to an intermediate step during the process of increase of the fuel pressure, so that the pressure of the fuel fed into the middle pressure pipe 40 is lower than the discharge pressure or the maximum pressure of the fuel discharged from the fuel pump 2. The fuel pump 2 may include an impeller(s) (not shown) having a plurality of fin grooves formed in its outer peripheral portion. The fuel is pumped and pressurized as the impeller rotates. A fuel passage (not shown) defining a pump chamber is formed to surround the outer peripheral portion of the impeller and extends in the circumferential direction, so that the pressure of the fuel within the fuel passage increases in a downstream direction along the fuel passage. Therefore, the position corresponding to the intermediate step during the process of increase of the fuel pressure may be an intermediate position along the length of the fuel passage. The other end of the middle pressure pipe 40 is connected to the three-way valve 19, so that the middle pressure pipe 40 communicates with the second introduction pipe 17 and the third introduction pipe 18 via the three-way valve 19. Therefore, the pressure of the fuel that may be introduced into the second pressure chamber 8 and the pressure of the fuel that may be introduced into the third pressure chamber 9 are the same with each other. Hence, the fuel pressure that is lower than the discharge pressure of the fuel pump 2 can be introduced into the second pressure chamber 8 and/or the third pressure chamber 9. In this way, the second embodiment utilizes the middle pressure pipe 40 in place of the throttles 35 to 37.

The operation of the three-way valve 19 for adjusting the fuel pressure fed through the fuel delivery pipe 5 to a high level, a middle level, or a low level is the same as the first embodiment. Thus, in order to set the fuel pressure within the fuel delivery pipe 5 to the high level, the three-way valve 19 is operated to bring the second introduction pipe 17 into the non-communicating condition and to bring the third introduction pipe 18 into the communicating condition as shown in FIG. 2(A), so that the fuel is introduced into the first pressure chamber 7 and the third pressure chamber 9. Also in this case, the force F for opening the valve member 23 may be calculated by the same expression as Expression (2) (F=(P1×A1)−(P3×A2)). In order to set the fuel pressure within the fuel delivery pipe 5 to the middle level, the three-way valve 19 is operated to bring both of the second introduction pipe 17 and the third introduction pipe 18 into the non-communicating condition as shown in FIG. 2(B), so that the fuel is introduced into only the first pressure chamber 7. Also in this case, the force F for opening the valve member 23 may be calculated by the expression (4) (F=(P1*A1)). In order to set the fuel pressure within the fuel delivery pipe 5 to the low level, the three-way valve 19 is operated to bring the second introduction pipe 17 into the communicating condition and bring the third introduction pipe 18 into the non-communicating condition as shown in FIG. 2(C), so that the fuel is introduced into the first pressure chamber 7 and the second pressure chamber 8. Also in this case, the force F for opening the valve member 23 may be calculated by the expression (5) (F=((P1−P2)*A1)+(P2*A2)).

Also in this embodiment, the fuel pressure that is introduced into the third pressure chamber 9 may be suitably changed as long as the expression (3) ((P1*A1)>(P3*A2)) is satisfied. The adjustment of the pressure of the fuel introduced into the third pressure chamber 9 can be made by changing the connecting position of the middle pressure pipe 40 to the fuel pump 2, which position corresponds to the intermediate step during the process of increase of the fuel pressure. Thus, the pressure of the fuel supplied into the middle pressure pipe 40, i.e., the pressure of the fuel introduced into the third pressure chamber 9 may be reduced as the connecting position of the middle pressure pipe 40 approaches to a position corresponding to an upstream side end of the intermediate step during the process of increasing the fuel pressure. On the contrary, the pressure of the fuel introduced into the third pressure chamber 9 may be increased as the connecting position of the middle pressure pipe 40 approaches to a position corresponding to a downstream side end of the intermediate step. Because the second introduction pipe 17 and the third introduction pipe 18 communicate with the middle pressure pipe 40 via the three-way valve 19, the pressure of the fuel introduced into the second pressure chamber 8 naturally changes to be equal to the pressure of the fuel introduced into the third pressure chamber 9 as the pressure of the fuel introduced into the third pressure chamber 9 is adjusted.

Third Embodiment

The third embodiment of the present invention will now be described with reference to FIGS. 3(A), 3(B) and 3(C), which show a high pressure mode, a middle pressure mode and a low pressure mode of a fuel supply apparatus 1C of the third embodiment, respectively. This embodiment is different from the fuel supply apparatus 1A and 1B of the first and second embodiments in that the pressure receiving area A2 of the second diaphragm 21 of the pressure regulator 3 is set to be greater than the pressure receiving area A1 of the first diaphragm 20. In addition, the first, second and third pressure chambers 7, 8 and 9 have no other openings or ports than the fuel introduction ports 11, 15 and 16, respectively. The second and third introduction pipes 17 and 18 communicate with the first introduction pipe 13 via the three-way valve 19. Therefore, each of the first and second and third pressure chambers 7, 8 and 9 receives the supply of the discharge pressure (maximum pressure) of the fuel pump 2. The fuel fed through the delivery pipe 5 can be set to a high level, a middle level and a low level by the different operations from the first and second embodiments.

Thus, in order to set the pressure of the fuel fed through the fuel delivery pipe 5 to the high level, the three-way valve 19 is operated to bring the second introduction pipe 17 into the non-communicating condition and to bring the third introduction pipe 18 into the communicating condition as shown in FIG. 3(A), so that the fuel is introduced into the first pressure chamber 7 and the third pressure chamber 9. Also in this case, the force F for opening the valve member 23 may be calculated by the same expression as Expression (2) (F=(P1*A1)−(P3*A2)). Thus, the valve member 23 receives a force (P1*A1) in an opening direction by the pressure within the first pressure chamber 7 while it receives a force (P3*A2) in a closing direction by the pressure within the third pressure chamber 9. Therefore, the amount of opening of the return port 12 is small, so that the pressure of the fuel fed through the fuel delivery pipe 5 is set to the high level. In this embodiment, the areas A1 and A2 have the relationship of A1>A2, and the pressure P1 of the fuel introduced into the first pressure chamber 7 and the pressure P3 of the fuel introduced into the third pressure chamber 9 are the same with each other and are equal to the discharge pressure (maximum pressure) from the fuel pump 2. Therefore, the force F may be calculated by the following expression (6) based on the expression (2):

$$F=P(A1-A2) \quad (6)$$

In this expression (6), P denotes the discharge pressure (maximum pressure) of the fuel pump 2. Therefore, it is possible to ensure that the force F is greater than the biasing force of the spring 26. The pressure receiving area A2 of the second diaphragm 21 may have any value as long as it is smaller than the pressure receiving area A1 of the first diaphragm 20. The high level value of the fuel pressure fed through the fuel delivery pipe 5 may increase as the difference between the areas A1 and A2 decreases. On the contrary, the high level value of the fuel pressure fed through the delivery pipe 5 may decrease as the difference between the areas A1 and A2 increases.

In order to set the pressure of the fuel fed through the fuel delivery pipe 5 to the middle level, the three-way valve 19 is operated to bring the second introduction pipe 17 into the communicating condition and to bring the third introduction pipe 18 into the non-communicating condition as shown in FIG. 3(B), so that the fuel is introduced into the first pressure chamber 7 and the second pressure chamber 8. Also in this case, the force F for opening the valve member 23 may be calculated by the expression (5) (F=((P1−P2)A1)+(P2×A2)). Because the discharge pressure P of the fuel pump 2 is directly applied to the first pressure chamber 7 and the second pressure chamber 8, the force F may be calculated by the following expression (7):

$$F=P*A2 \quad \text{Expression (7)}$$

Therefore, the force F applied for opening the valve member 23 in this case is greater than the force F calculated by the expression (6)(F=P(A1−A2)) in the case of setting the fuel pressure to the high level. Hence, the amount of opening the return port 12 becomes greater than that achieved in the case of setting to the high level. As a result, the fuel pressure within the fuel delivery pipe 5 can be set to the middle level.

In order to set the pressure of the fuel fed through the fuel delivery pipe 5 to the low level, the three-way valve 19 is operated to bring the both of the second introduction pipe 17 and the third introduction pipe 18 into the non-communicating condition as shown in FIG. 3(C), so that the fuel is introduced into only the first pressure chamber 7. Also in this case, the force F for opening the valve member 23 may be calculated by the following expression (8) based on the expression (1).

$$F=P1*A1=P*A1 \quad \text{Expression (8)}$$

Because A1>A2, the value of (P*A1) is great than the vale of (P1*A2) achieved in the case of setting to the middle level. Therefore, the amount of opening of the return port 12 is greater than that achieved in the case of setting to the middle level. As a result, the pressure of the fuel fed through the fuel delivery pipe 5 can be set to the low level.

In this way, in the case of the third embodiment in which the pressure receiving area A2 of the second diaphragm 21 of the pressure regulator 3 is set to be larger than the pressure receiving area A1 of the first diaphragm 20, the high level pressure value of the fuel fed through the fuel delivery pipe 5 depends on the pressure P3 of the fuel introduced into the third pressure chamber 9. Therefore, in order to achieve the maximum pressure value for the high level setting when the engine is restarted, it is preferable that the pressure P3 of the fuel introduced into the third pressure chamber 9 is equal to the pressure P1 of the fuel introduced into the first pressure chamber 7 as in the third embodiment. On the other hand, if it is not necessary to achieve the maximum pressure value, the third embodiment may be modified such that a middle pressure lower than the discharge pressure P of the fuel pump 2 is introduced into the second pressure chamber 8 and/or the third pressure chamber 9 as in the arrangement of the first or second embodiment.

Fourth Embodiment

The fourth embodiment of the present invention will now be described with reference to FIGS. 4(A), 4(B) and 4(C), which show a high pressure mode, a middle pressure mode and a low pressure mode of a fuel supply apparatus 1D of the fourth embodiment, respectively. This embodiment corresponds to the third embodiment incorporating the arrangement of the first embodiment. Thus, the pressure regulator 3 of the fuel supply apparatus 1D according to this embodiment is different from the third embodiment in that the return ports 31 and 32 are formed in communication with the second pressure chamber 8 and the third pressure chamber 9, respectively, for returning the introduced fuel into the fuel tank. The return ports 31 and 32 are open into and out of the second pressure chamber 8 and the third pressure chamber 9, respectively. In addition, the return pipes 33 and 34 are connected to the return ports 31 and 32, respectively, and are in communication with the inner space of the fuel tank T (not shown in FIGS. 4(A), 4(B), 4(C)). Further, the throttles 35 and 36 are disposed within the second introduction pipe 17 and the third introduction pipe 18, respectively, for restricting the flow of the fuel therethrough. The second introduction pipe 17 is connected to the upstream side of the second pressure chamber 8, and the third introduction pipe 18 is connected to the upstream side of the third pressure chamber 9. Furthermore, the throttles 37 and 38 are disposed within the return pipes 33 and 34, respectively, for restricting the flow of the fuel therethrough. The return pipe 33 is connected to the downstream side of the second pressure chamber 8, and the return pipe 34 is connected to the downstream side of the third pressure chamber 9. The amount of restriction of flow by the throttles 37 and 38 positioned on the downstream side of the second and third pressure chambers 8 and 9 are set to be greater than the amount of restriction of flow by the throttles 35 and 36 positioned on the upstream side of the second and third pressure chambers 8 and 9. The second introduction pipe 17 and the third introduction pipe 18 are connected to the first introduction pipe 13 via the three-way valve 19 in such a manner that the second introduction pipe 17 and the third introduction pipe 18 are branched from the first introduction pipe 13 via the three-way valve 19. Therefore, the discharge pressure P of the fuel pump 2 is directly introduced into the first pressure chamber 7, while a pressure lower than the discharge pressure P is introduced into each of the second pressure chamber 8 and the third pressure chamber 9.

Also with this arrangement, the high level, middle level and low level of the fuel fed through the delivery pipe 5 can be set by the same operations as the third embodiment. Thus, in order to set the pressure of the fuel fed through the fuel delivery pipe 5 to the high level, the three-way valve 19 is operated to introduce the fuel into the first pressure chamber 7 and the third pressure chamber 9 as shown in FIG. 4(A). Also in this case, the force F for opening the valve member 23 may be calculated by the same expression as Expression (2) (F=(P1*A1)−(P3*A2)). Because the fuel pressure P3 introduced into the third pressure chamber 9 is lower than the fuel pressure P1 that is introduced into the first pressure chamber 7 and equal to the discharge pressure P of the fuel pump 2 in this embodiment, the value of the force (P3*A2) is smaller than that achieved in the case of the third embodiment. Therefore, the pressure value at the high level achieved in this embodiment is lower than that achieved in the case of the third embodiment.

In order to set the pressure of the fuel fed through the fuel delivery pipe 5 to the middle level, the three-way valve 19 is operated to introduce the fuel into the first pressure chamber 7 and the second pressure chamber 8 as shown in FIG. 4(B). Also in this case, the force F for opening the valve member 23 may be calculated by the expression (5) (F=((P1-P2)A1)+(P2*A2)). Because P1=P>P2, the pressure value at the middle level achieved in this embodiment is lower than that achieved in the case of the third embodiment.

In order to set the pressure of the fuel fed through the fuel delivery pipe 5 to the low level, the three-way valve 19 is operated to introduce the fuel into only the first pressure chamber 7. Also in this case, the force F for opening the valve member 23 may be calculated by the expression (8) (F=P1*A1=P*A1).

Fifth Embodiment

Figure 5A:
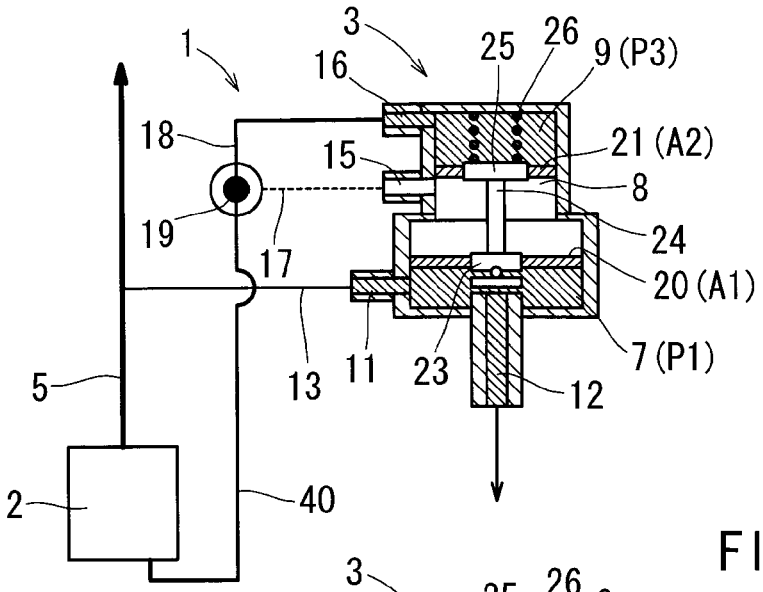
FIGS. 5(A), 5(B) and 5(C) are schematic views showing different operational modes of a fuel supply apparatus according to a fifth embodiment of the present invention.
Figure 5B:
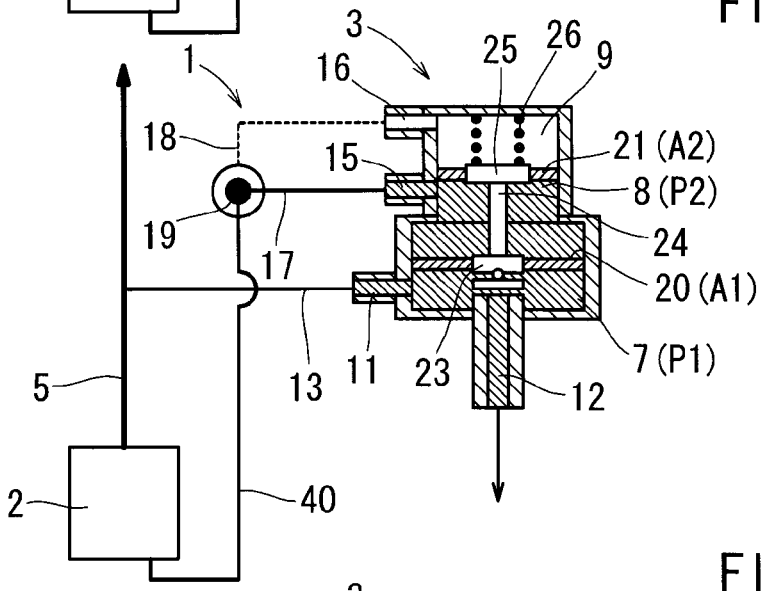
Figure 5C:
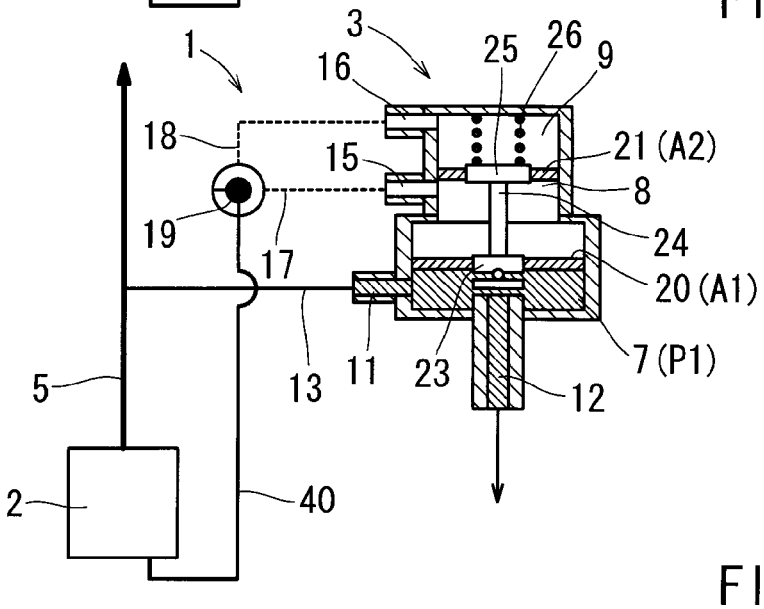

The fifth embodiment of the present invention will now be described with reference to FIGS. 5(A), 5(B) and 5(C), which show a high pressure mode, a middle pressure mode and a low pressure mode of a fuel supply apparatus 1E of the fifth embodiment, respectively. This embodiment corresponds to the third embodiment incorporating the arrangement of the middle pressure introduction mechanism of the second embodiment in order to introduce the middle pressure, which is lower than the discharge pressure P of the fuel pump 2, into the second and third pressure chambers 8 and 9 as in the case of the fourth embodiment.

Thus, In the fifth embodiment, one end of the middle pressure pipe 40 is connected to the fuel pump 2 at a position corresponding to an intermediate step during the process of increase of the fuel pressure, so that the pressure of the fuel fed into the middle pressure pipe 40 is lower than the discharge pressure P of the fuel pump 2. The other end of the middle pressure pipe 40 is connected to the three-way valve 19, so that the middle pressure pipe 40 communicates with the second introduction pipe 17 and the third introduction pipe 18 via the three-way valve 19. Therefore, the pressure of the fuel that may be introduced into the second pressure chamber 8 and the pressure of the fuel that may be introduced into the third pressure chamber 9 are the same with each other. Hence, the fuel pressure that is lower than the discharge pressure P of the fuel pump 2 is introduced into the second pressure chamber 8 and/or the third pressure chamber 9.

Also with this arrangement, the pressure of the fuel fed through the delivery pipe 5 can be set to the high level, the middle level and the low level by the same operations as the third and fourth embodiments. Thus, in order to set the pressure of the fuel fed through the fuel delivery pipe 5 to the high level, the three-way valve 19 is operated to introduce the fuel into the first pressure chamber 7 and the third pressure chamber 9 as shown in FIG. 5(A). In order to set the pressure of the fuel fed through the fuel delivery pipe 5 to the middle level, the three-way valve 19 is operated to introduce the fuel into the first pressure chamber 7 and the second pressure chamber 8 as shown in FIG. 5(B). In order to set the pressure of the fuel fed through the fuel delivery pipe 5 to the low level, the three-way valve 19 is operated to introduce the fuel into only the first pressure chamber 7 as shown in FIG. 5(C).

(Possible Modifications of First to Fifth Embodiments)

The first embodiment may be modified to omit the return port 31 and the throttles 35 and 37. With this modification, the pressure P2 introduced into the second pressure chamber 8 and the pressure P1 introduced into the first pressure chamber 7 may become equal to each other and may be equal to the discharge pressure P of the fuel pump 2. Therefore, in this case, the force F for opening the valve member 23 may be calculated by the following expression (9) based on the expression (1).

$$F=P*A2 \qquad \text{Expression (9)}$$

Therefore, the amount of opening of the return port 12 achieved in this embodiment may be greater than that achieved in the case of the first embodiment. Thus, it is possible to achieve the minimum pressure value at the low level setting.

In the fourth embodiment, one of the return ports 31 and 32 of the first and second pressure chambers 8 and 9 may be omitted.

In the first to fifth embodiments, the set pressure of the fuel at the high-temperature condition and the set pressure of the fuel at the low-temperature condition may be different from those disclosed in these embodiments. For example, the fuel pressure may be set to the middle level at the low temperature condition and may be set to the high level at the high temperature condition or vice versa. In addition, it is possible to set the fuel pressure at a different level from the low level during the normal operating condition of the engine. The amount of discharge of the fuel from the fuel pump 2 is inversely proportional to the maximum amount of possible fuel consumption at the engine. Therefore, the maximum amount of possible fuel consumption may decrease as the fuel pressure increases while it may increase as the fuel pressure decreases. Therefore, it may be possible to set the fuel pressure to the high level when the engine is started, to set the fuel pressure to the middle level during the normal operating condition, i.e., the low load condition of the engine, and to set the fuel pressure to the low level during the acceleration of the engine speed, i.e., the high load condition that requires an increased amount of the fuel. In this case, the fuel pressure may not be changed in response to the temperature of the fuel but may be changed in response to the amount of the fuel required for consumption at the engine. Therefore, the fuel pressure may be changed based on change of various parameters including an open angle of a throttle valve, the rotational speed of an engine, the amount of intake air, and a reference pulse signal for injecting fuel from an injector(s).

This invention claims:

1. A fuel supply apparatus comprising:

a fuel pump connected to a fuel delivery pipe for delivering a fuel to an internal combustion engine;

a pressure regulator constructed to adjust a pressure of the fuel fed through the fuel delivery pipe, wherein the fuel pump and the pressure regulator are disposed within a fuel tank;

wherein the pressure regulator comprises:

a first pressure chamber including a return port for returning the fuel into the fuel tank;

a second pressure chamber;

a third pressure chamber;

a valve assembly including a valve member capable of opening and closing the return port, a pressure receiving member and a connecting rod connecting between the valve member and the pressure receiving member, so that the valve member can move together with the pressure receiving member;

a first diaphragm having a first pressure receiving area and constructed to separate the first pressure chamber and the second pressure chamber from each other and to resiliently support the valve member;

a second diaphragm having a second pressure receiving area and constructed to separate the second pressure chamber and the third pressure chamber from each other, wherein first pressure receiving area and the second pressure receiving area are different from each other;

a first introduction passage connecting between the fuel pump and the first pressure chamber;

a second introduction passage connecting between the fuel pump and the second pressure chamber;

a third introduction passage connecting between the fuel pump and the third pressure chamber; and a changeover device operable to selectively permit or prevent communication between the second introduction passage and the second pressure chamber and to selectively permit or prevent communication between the third introduction passage and the third pressure chamber, so that the fuel from the fuel pump can be selectively introduced into the second pressure chamber and can be selectively introduced into the third pressure chamber for adjusting a supply pressure of the fuel fed through the fuel delivery pipe to any one of a first level, a second level lower than the first level, and a third level lower than the second level.

2. The fuel supply apparatus as in claim 1, wherein:

the second pressure receiving area of the second diaphragm is set to be larger than the first pressure receiving area of the first diaphragm;

the first pressure chamber directly receives the supply of the fuel having a discharge pressure from the fuel pump;

at least the third pressure chamber of the second pressure chamber and the third pressure chamber receives the supply of the fuel having a pressure lower than the discharge pressure;

the changeover device is operable in a first mode, a second mode and a third mode, in the first mode, the first and third pressure chambers receive the supply of the fuel, so that the supply pressure is set to the first level;

in the second mode, only the first pressure chamber receives the supply of the fuel, so that the supply pressure is set to the second level; and in the third mode, the first and second pressure chambers receive the supply of the fuel, so that the supply pressure is set to the third level.

3. The fuel supply apparatus as in claim 1, wherein:

the second pressure receiving area of the second diaphragm is set to be smaller than the first pressure receiving area of the first diaphragm;

the changeover device is operable in a first mode, a second mode and a third mode, in the first mode, the first and third pressure chambers receive the supply of the fuel, so that the supply pressure is set to the first level;

in the second mode, the first and second pressure chambers receive the supply of the fuel, so that the supply pressure is set to the second level; and in the third mode, only the first pressure chamber receives the supply of the fuel, so that the supply pressure is set to the third level.

4. The fuel supply apparatus as in claim 2, wherein:

the first introduction passage communicates with the fuel delivery pipe;

the second and third introduction passages communicate with the first introduction passage via the changeover device;

each of the second and third pressure chambers communicates with the inside of the fuel tank via a return port;

a first throttle and a second throttle are disposed within the second introduction passage and the third introduction passage, respectively;

a third throttle is disposed on a downstream side of the return port of the second pressure chamber;

a fourth throttle is disposed on a downstream side of the return port of the third pressure chamber;

a throttling amount of the third throttle is greater than a throttling amount of the first throttle, so that the flow area defined by the third throttle is smaller than the flow area defined by the first throttle; and a throttling amount of the fourth throttle is greater than a throttling amount of the second throttle, so that the flow area defined by the fourth throttle is smaller than the flow area defined by the second throttle.

5. The fuel supply apparatus as in claim 3, wherein:

the first introduction passage communicates with the fuel delivery pipe;

the second and third introduction passages communicate with the first introduction passage via the changeover device;

each of the second and third pressure chambers communicates with the inside of the fuel tank via a return port;

a first throttle and a second throttle are disposed within the second introduction passage and the third introduction passage, respectively;

a third throttle is disposed on a downstream side of the return port of the second pressure chamber;

a fourth throttle is disposed on a downstream side of the return port of the third pressure chamber;

a throttling amount of the third throttle is greater than a throttling amount of the first throttle, so that the flow area defined by the third throttle is smaller than the flow area defined by the first throttle; and a throttling amount of the fourth throttle is greater than a throttling amount of the second throttle, so that the flow area defined by the fourth throttle is smaller than the flow area defined by the second throttle.

6. The fuel supply apparatus as in claim 2, wherein:

the fuel delivery pipe receives the supply of the fuel discharged from the fuel pump at an end of the pressurizing process of the fuel pump;

the first introduction passage communicates with the fuel delivery pipe;

the second and third introduction passages communicate with the fuel pump via a middle pressure passage; and the middle pressure passage receives the supply of the fuel discharged from the fuel pump at an intermediate step of the pressurizing process of the fuel.

7. The fuel supply apparatus as in claim 3, wherein:

the fuel delivery pipe receives the supply of the fuel discharged from the fuel pump at an end of the pressurizing process of the fuel pump;

the first introduction passage communicates with the fuel delivery pipe;

the second and third introduction passages communicate with the fuel pump via a middle pressure passage; and the middle pressure passage receives the supply of the fuel discharged from the fuel pump at an intermediate step of the pressurizing process of the fuel.

8. A fuel supply apparatus for supplying a fuel to a target, comprising:

a fuel pump;

a fuel delivery passage communicating between the fuel pump and the target; and a pressure regulator constructed to regulate a pressure of the fuel fed to the target through the fuel delivery passage;

wherein the pressure regulator comprises:

a first pressure chamber, a second pressure chamber and a third pressure chamber each configured to be able to received a supply of the fuel from the fuel pump;

a first diaphragm separating the first pressure chamber and the second pressure chamber from each other;

a second diaphragm separating the second pressure chamber and the third pressure chamber from each other;

wherein the first pressure chamber has a discharge port configured to discharge the fuel supplied into the first pressure chamber;

a valve assembly coupled to the first and second diaphragms, so that the valve assembly can open and close the discharge port of the first pressure chamber in response to forces applied to the first and second diaphragms by pressures of the fuel within the first, second and third pressure chambers; and a controller configured to control the pressure of the fuel within each of the second and third pressure chambers.

9. The fuel supply apparatus as in claim 8, wherein the controller is configured to permit or prevent the supply of the fuel from the fuel pump into the second pressure chamber and to permit or prevent the supply of the fuel from the fuel pump into the third pressure chamber.

10. The fuel supply apparatus as in claim 8, wherein:

the valve assembly comprises:

a first member mounted to the first diaphragm and comprising a valve member positioned to be opposed to the discharge port of the first pressure chamber;

a second member mounted to the second diaphragm; and a connecting member connecting between the first member and the second member.

11. The fuel supply apparatus as in claim 8, wherein the force applied to the valve assembly is calculated by the following expression:

$$F=(P1*A1)-(P2*A1)+(P2*A2)-(P3*A2)$$

where F denotes the force applied to the valve assembly in a direction for opening the discharge port, P1 denotes the pressure within the first pressure chamber, P2 denotes the pressure within the second pressure chamber, P3 denotes the pressure within the third pressure chamber, Al denotes a first pressure receiving area of the first diaphragm, and A2 denotes a second pressure receiving area of the second diaphragm.

12. The fuel supply apparatus as in claim 11, wherein:

the controller is operable in a first mode, a second mode and a third mode for producing a first value, a second value and a third value of the force (F) applied to the valve assembly in the direction for opening the discharge port, respectively;

the first value is larger than the second value; and the second value is larger than the third value.

13. The fuel supply apparatus as in claim 12, wherein:

the first pressure receiving area (A1) is smaller than the second pressure receiving area (A2);

the fuel is prevented from being supplied into the second pressure chamber but is permitted to be supplied into the third pressure chamber in the first mode;

the fuel is prevented from being supplied into both of the second pressure chamber and the third pressure chamber in the second mode; and the fuel is permitted to be supplied into the second pressure chamber but is prevented from being supplied into the third pressure chamber in the third mode.

14. The fuel supply apparatus as in claim 13, wherein the controller comprises a three-way valve connected between the fuel pump and each of the second and third pressure chambers.

15. The fuel supply apparatus as in claim 13, wherein the pressure of the fuel supplied into each of the second and third pressure chambers is lower than the pressure of the fuel supplied into the first pressure chamber.

16. The fuel supply apparatus as in claim 12, wherein:

the first pressure receiving area (A1) is larger than the second pressure receiving area (A2);

the fuel is prevented from being supplied into the second pressure chamber but is permitted to be supplied into the third pressure chamber in the first mode;

the fuel is permitted to be supplied into the second pressure chamber but is prevented from being supplied into the third pressure chamber in the second mode;

the fuel is prevented from being supplied into both of the second pressure chamber and the third pressure chamber in the third mode.

17. The fuel supply apparatus as in claim 16, wherein the controller comprises a three-way valve connected between the fuel pump and each of the first and second pressure chambers.

18. The fuel supply apparatus as in claim 16, wherein the pressure of the fuel supplied into each of the second and third pressure chambers is lower than the pressure of the fuel supplied into the first pressure chamber.

* * * * *